US009697932B2

(12) United States Patent
Funayama et al.

(10) Patent No.: US 9,697,932 B2
(45) Date of Patent: Jul. 4, 2017

(54) METHOD FOR MANUFACTURING INSULATED WIRE

(71) Applicant: HITACHI METALS, LTD., Tokyo (JP)

(72) Inventors: Yasuhiro Funayama, Tokyo (JP); Yosuke Watanabe, Ibaraki (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/156,822

(22) Filed: Jan. 16, 2014

(65) Prior Publication Data

US 2014/0199471 A1 Jul. 17, 2014

(30) Foreign Application Priority Data

Jan. 16, 2013 (JP) ..... 2013-005769

(51) Int. Cl.

| | |
|---|---|
| ***B05D 7/20*** | (2006.01) |
| ***H01B 13/06*** | (2006.01) |
| *H01B 13/14* | (2006.01) |
| *H01B 13/24* | (2006.01) |
| *H01B 13/16* | (2006.01) |

(52) U.S. Cl.

CPC ..... *H01B 13/065* (2013.01); *B05D 7/20* (2013.01); *H01B 13/14* (2013.01); *H01B 13/145* (2013.01); *H01B 13/16* (2013.01); *H01B 13/24* (2013.01)

(58) Field of Classification Search

USPC ..... 427/8, 117–120

See application file for complete search history.

(56) References Cited

U.S. PATENT DOCUMENTS 2,215,996 A * 9/1940 Benton ..... B05D 7/20 118/47
3,265,033 A * 8/1966 Touze et al. ..... 118/61
3,826,690 A * 7/1974 Bleinberger et al. ..... 148/526

(Continued)

FOREIGN PATENT DOCUMENTS

CN 102568663 7/2012
JP 56-116213 * 9/1981

(Continued)

OTHER PUBLICATIONS

English translation of Japanese Office Action for Patent Application 2013-005769, dated Dec. 18, 2015.

(Continued)

*Primary Examiner* — Brian K Talbot

(74) *Attorney, Agent, or Firm* — Paul D. Bianco; Katharine Davis; Fleit Gibbons Gutman Bongini & Bianco PL

(57) ABSTRACT

There is provided a method for manufacturing an insulated wire, including at least: coating an outer periphery of a running wire with an insulation coating material discharged from a coating material discharging tank; baking the insulation coating material by an incinerator, the insulation coating material being used for coating the outer periphery of the running wire; and cooling the running wire by a cooling mechanism so that a temperature of the running wire before being coated with the insulation coating material, is a specific temperature, based on a temperature of the running wire detected by a temperature detector, wherein the coating, the baking, and the cooling are repeated.

9 Claims, 2 Drawing Sheets

(56) References Cited

U.S. PATENT DOCUMENTS

| | | | | | |
|---|---|---|---|---|---|
| 4,104,416 | A * | 8/1978 | Parthasarathy et al. | ..... | 427/473 |
| 4,611,747 | A * | 9/1986 | Peppler et al. | ..... | 228/125 |
| 6,146,699 | A * | 11/2000 | Bonicel et al. | ..... | 427/299 |
| 6,416,813 | B1 * | 7/2002 | Valls Prats | ..... | 427/118 |
| 6,487,470 | B1 * | 11/2002 | Sedlak | ..... | B05C 3/12 428/383 |
| 8,784,993 | B2 | 7/2014 | Yin et al. | | |
| 9,153,379 | B2 | 10/2015 | Yin et al. | | |
| 2002/0112344 | A1 | 8/2002 | Harada et al. | | |
| 2007/0248821 | A1 * | 10/2007 | Fournier et al. | ..... | 428/375 |
| 2012/0152590 | A1 | 6/2012 | Yin et al. | | |

FOREIGN PATENT DOCUMENTS

| | | | | |
|---|---|---|---|---|
| JP | S56116213 | A | | 9/1981 |
| JP | 58-128607 | | * | 1/1983 |
| JP | S58128607 | A1 | | 8/1983 |
| JP | 59-046712 | | * | 3/1984 |
| JP | S63162414 | A | | 7/1988 |
| JP | S63162414 | U | | 10/1988 |
| JP | 63-162414 | | * | 10/1998 |
| JP | 2002-109974 | A | | 4/2002 |

OTHER PUBLICATIONS

Chinese Office Action dated Jun. 1, 2016 for Chinese Application No. 201410016440.6.

* cited by examiner

METHOD FOR MANUFACTURING INSULATED WIRE

BACKGROUND

Technical Field

The present application is based on Japanese Application No. 2013-005769 filed on Jan. 16, 2013, the entire contents of which are hereby incorporated by reference.

The present invention relates to a method for manufacturing an insulated wire and a manufacturing apparatus of the same.

Description of Related Art

An insulated wire is used for a coil of electric equipment such as a motor and a transformer. The insulated wire includes a conductor and an insulated coating film (insulated layer) formed on an outer periphery of the conductor. As the insulated wire, a round type electric wire using approximately circular conductor in cross-section, and a square electric wire (called a square conductor hereafter) using approximately a rectangular conductor in cross-section, can be given, which can be selected according to a purpose of use and a shape of the coil.

The insulated wire is manufactured while running the conductor as shown below at a specific speed. First, the conductor is run by a running machine to obtain a running wire. The running wire thus obtained is introduced to a coating material discharging tank, to thereby coat an outer periphery of the running wire with an insulation coating material. Next, the running wire coated with the insulation coating material is introduced to an incinerator, and the insulation coating material is baked and cured, to thereby obtain an insulated layer. Then, these steps are repeated multiple numbers of times until the insulated layer has a specific thickness, to thereby obtain an insulated wire (for example, see patent reference 1).

In recent years, miniaturization of the electric equipment such as a motor and a transformer is requested, and miniaturization is also required for the coil used for them. Owing to such a miniaturization of the coil, a space factor of the insulated wire can be improved. In order to improve the space factor, the square electric wire is more frequently used than the round type electric wire as the insulated wire, and the insulated layer is requested to be thin and uniform.

However, when the insulated wire is manufactured, and particularly when the square electric wire is manufactured, there is a problem that a coating of the formed insulated layer is easily ununiform, even in a case of a uniform coating of the insulation coating material. Namely, a thickness of the insulated layer in a peripheral direction of the insulated wire is easily ununiform. Such a phenomenon is generated, because the insulation coating material used for coating flows by surface tension before being cured, which is then cured in this state. For example, when the square conductor are uniformly coated with the insulation coating material, the thickness becomes small because the insulation coating material flows by the surface tension at a corner section of the square conductor, and meanwhile, at a planar section interposing the corner section, the thickness is large by swelling caused by the insulation coating material flowed from the corner section. Thus, by curing of the insulation coating material in a flowing state, the thickness of the formed insulated layer becomes ununiform.

As a method of improving the coating of the insulated layer, there is a method of increasing a viscosity of the insulation coating material and suppressing the flow of the insulation coating material by surface tension.

Patent reference 1: Japanese Patent Laid Open Publication No. 2002-109974

SUMMARY OF THE INVENTION

Incidentally, in manufacturing the insulated wire, the running wire is introduced to the coating material discharging tank and the incinerator, etc., to form the insulated layer. A running speed of the running wire in this case, corresponds to a productivity of the insulated wire. In manufacturing the insulated wire, the productivity can be improved by increasing the running speed of the running wire.

However, conventionally, there is an upper limit in the running speed of the running wire, and it is difficult to further improve the productivity by such a high speed of the running speed. When the running speed is increased, it becomes difficult to maintain the viscosity of the insulation coating material to be high and constant with an elapse of a manufacturing time, although the coating of the insulating layer can be uniform, because the viscosity of the insulation coating material is high in the beginning. Therefore, a flowing performance of the insulation coating material is gradually changed during manufacture, and the coating of the insulated layer is likely to be ununiform. Namely, in the manufactured insulated wire, the coating of the insulated layer is ununiform and the thickness of the insulated layer is ununiform in a longitudinal direction.

In view of the above-mentioned subject, the present invention is provided, and an object of the present invention is to provide a method for manufacturing an insulated wire and a manufacturing apparatus of the same, capable of uniformizing the thickness of the insulated layer in a longitudinal direction of the insulated wire, even in a case of improving the productivity.

According to an aspect of the present invention, there is provided a method for manufacturing an insulated wire of forming an insulated layer on a running wire, including at least:

coating an outer periphery of a running wire with an insulation coating material discharged from a coating material discharging tank;

baking the insulation coating material by an incinerator, the insulation coating material being used for coating the outer periphery of the running wire; and cooling the running wire by a cooling mechanism so that a temperature of the running wire before being coated with the insulation coating material, is a specific temperature, based on a temperature of the running wire detected by a temperature detector, wherein the coating, the baking, and the cooling are repeated.

According to other aspect of the present invention, there is provided a manufacturing apparatus of an insulated wire, including:

a coating material discharging tank configured to coat an outer periphery of a running wire with an insulation coating material;

an incinerator configured to bake the insulation coating material used for coating the running wire;

a temperature detector configured to detect a temperature of the running wire;

a cooling mechanism configured to cool the running wire; and a control mechanism configured to control the cooling mechanism so that the temperature of the running wire is a specific temperature, based on the temperature of the running wire detected by the temperature detector.

DETAILED DESCRIPTION OF THE INVENTION

Figure 1:
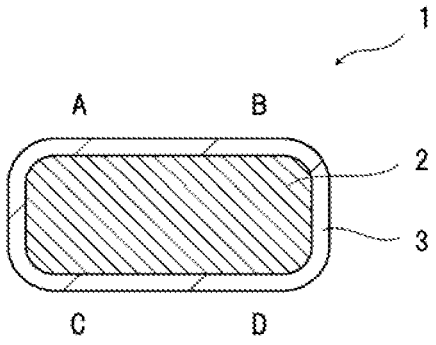
FIG. 1 is a view showing a sectional surface of an insulated wire obtained by a manufacturing method according to an embodiment of the present invention.

Knowledge Obtained by Inventors of the Present Invention

Prior to the explanation for an embodiment of the present invention, knowledge obtained by inventors of the present invention will be described.

In order to uniformize a coating of an insulated layer, it can be considered that viscosity of an insulation coating material is maintained to be high and constant. However, as described above, if a running speed of a running wire is set to be high when manufacturing the insulated wire such as a square electric wire, coating of the insulated layer is ununiform and its thickness is ununiform in a longitudinal direction of the insulated wire. Particularly, when the thickness of the insulated layer is larger than 30 μm, ununiformity of the thickness is remarkable, and a variation in the thickness becomes large.

The inventors of the present invention consider as follows: the coating of the insulated layer is ununiform when setting a high running speed, although the viscosity of the insulation coating material is maintained to be high and the flow of the insulation coating material by surface tension is suppressed, and therefore a variation of the viscosity of the insulation coating material is influenced by the running speed of the running wire. As a result of strenuous efforts by the inventors of the present invention regarding this point, it is found that when high speed running is carried out, the temperature of the running wire is increased, and with an increase of the temperature, the temperature of the insulation coating material is also increased, thus reducing the viscosity of the insulation coating material.

When such a high speed running is carried out, the temperature of the running wire is increased and the viscosity of the insulation coating material is reduced as shown below.

The insulated wire is manufactured by repeating coating the outer periphery of the running wire for running a conductor, with the insulation coating material, and baking the insulation coating material. If the high-speed running is carried out, the running wire is not sufficiently cooled after baking, and the temperature of the running wire is increased. Since the running wire passes through the insulation coating material, heat is transferred to the insulation coating material if the temperature of the running wire is increased, and the temperature of the insulation coating material is also increased, and the viscosity is reduced. In addition, when the high speed running is carried out, a cycle of the manufacturing step (such as coating and baking of the insulation coating material) is shortened, and a pace of baking is also shortened, thus further increasing the temperature of the running wire. Then, the temperature of the insulation coating material is further increased with an increase of the temperature of the running wire, thus greatly reducing the viscosity. As a result, in the manufactured insulated wire, the coating of the insulated layer is ununiform and the thickness of the insulated layer is also ununiform in the longitudinal direction. Namely, when the high speed running is carried out, the temperature of the running wire is increased, and the temperature of the insulation coating material is also gradually increased accordingly, thus reducing the viscosity of the insulation coating material with an elapse of the manufacturing time, and the coating of the insulating layer becomes ununiform in the longitudinal direction of the insulated wire.

From this point, it can be considered that the coating of the insulated layer is improved by heating or cooling the insulation coating material, and controlling the temperature and the viscosity to be constant. However, when an amount of the insulation coating material is small, which is used for coating the running wire, namely, when a thin insulated layer having a thickness of 50 μm for example is formed, the insulation coating material used for coating is little, and a heat quantity of the insulation coating material is small compared with the heat quantity of the running wire, and therefore the temperature of the insulation coating material is close to the temperature of the running wire, and it becomes difficult to set a constant viscosity.

Meanwhile, the temperature of the running wire is varied not only by the running speed but also by environments such as day and night, season, and weather, etc., in which the insulated wire is manufactured. According to the change of the environments, the temperature is changed and therefore the degree of the cooling is different when air-cooing is performed after baking the running wire. If the degree of the cooling is different, the temperature of the running wire is different, and the temperature of the insulation coating material and the viscosity are also different. Thus, the coating of the insulated layer becomes ununiform in the longitudinal direction of the insulated wire.

Thus, the temperature and the viscosity are varied corresponding to the variation of the temperature of the running wire which is varied by the running speed and an atmospheric temperature. As a result, in the manufactured insulated wire, the coating of the insulted layer is ununiform and the thickness is ununiform in the longitudinal direction.

As described above, it is found by the inventors of the present invention, that even when the running speed of the running wire is increased, the variation of the temperature of the insulation coating material can be suppressed and the variation of the viscosity can be suppressed if suppressing the variation of the temperature of the running wire during manufacture of the insulated wire. Namely, knowledge is obtained as follows: if the insulated wire is manufactured while cooling the running wire so that the temperature of the running wire immediately before being coated with the insulation coating material, is set to a specific temperature, the ununiformity of the thickness of the insulated layer can be suppressed even when the high speed running of the running wire is carried out. The present invention is provided based on the above knowledge.

An Embodiment of the Present Invention

Figure 2:
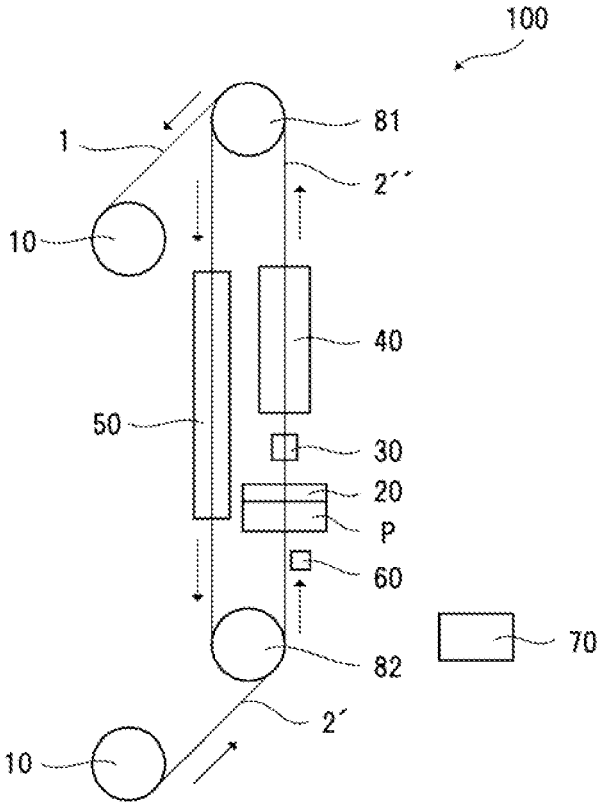
FIG. 2 is a schematic block diagram of a manufacturing apparatus of the insulated wire according to an embodiment of the present invention.

A method for manufacturing an insulated wire and a manufacturing apparatus of the same according to an embodiment of the present invention, will be described hereafter. In this embodiment, as shown in FIG. 1, an insulated wire 1 is manufactured, having a conductor 2 and an insulated layer 3 formed on the outer periphery of the conductor 2. In manufacturing the insulated wire 1, for example a manufacturing apparatus of the insulated wire shown in FIG. 2 is used. FIG. 1 is a view showing a cross-sectional surface of the insulated wire obtained by the manufacturing method according to an embodiment of the present invention. FIG. 2 is a schematic block diagram of the manufacturing apparatus of the insulated wire according to an embodiment of the present invention.

Explanation is given hereafter, with a running conductor 2 defined as the running wire, wherein the running wire introduced to an incinerator 40 is indicated by running wire 2', and the running wire passing through the incinerator 40 and introduced to a cooling mechanism 50 is defined as running wire 2".

(1) Manufacturing Apparatus of the Insulated Wire

As shown in FIG. 2, a manufacturing apparatus 100 of the insulated wire of this embodiment includes: a coating material discharging tank 20 for coating the outer periphery of the running wire 2' with an insulation coating material P; a coating die 30 for adjusting a coating amount of the insulation coating material P used for coating the outer periphery of the running wire 2'; an incinerator 40 for baking the insulation coating material P used for coating the running wire 2', a cooling mechanism 50 for cooling the running wire 2" that passes through the incinerator 40; a temperature detector 60 for detecting a temperature of the running wire 2'; and a control mechanism 70 for controlling the cooling mechanism 50 so as to cool the running wire 2" so that a temperature of the running wire 2" immediately before coating it with the insulation coating material P discharged from the coating material discharging tank 20, is a specific temperature, based on the temperature of the running wire 2' detected by the temperature detector 60, on a running route between running machines 10 and 10 for running the conductor 2. Further, an upper pulley 81 and a lower pulley 82 are provided on the running route, for guiding the running wire 2' and the running wire 2".

Running machines 10, 10 function to run the running wires 2' and 2" at a specific speed. As shown in a direction indicated by arrow in FIG. 2, the running wires 2' and 2" are hooked on the lower pulley 82 and are guided to an upper side, passing through the coating material discharging tank 20, the coating die 30, and the incinerator 40, and are hooked on the upper pulley 81 and are guided to a lower side, passing through the cooling mechanism 50, and are guided to the upper side at a point of the lower pulley 82. After multiple numbers of times of this cycle, the running wires 2' and 2" are finally recovered as the insulated wire 1.

The running speed of the conductor 2 between the running machines 10 and 10, is not particularly limited, but if the running speed is excessively slow, productivity is low. Meanwhile, if the running speed is excessively fast, there is a risk of adding a load on the manufacturing apparatus 100. The running speed of the conductor 2 is determined by a sectional area of the running conductor 2 (running wire 2'). Specifically, when the running speed of the conductor 2 is set as V (m/min), and a diameter (m) of a circle having the same sectional area ($mm^2$) as a sectional area ($mm^2$) of the conductor 2, is set as D, the conductor 2 is preferably run, so that V×D is 15 or more and 60 or less. As shown in FIG. 1, when the conductor 2 has a square shaped sectional surface, and when this sectional area is indicated by S ($mm^2$), the diameter of a circle having the same sectional area S is indicated by D. When V×D exceeds 60, the viscosity of the insulation coating material cannot be maintained to be high, and it is difficult to suppress the flow of the insulation coating material. Meanwhile, when V×D is less than 15, the running speed is slow, and there is a risk of low productivity. FIG. 1 shows a case that the conductor 2 has the square shaped sectional surface. However, the sectional shape of the conductor 2 is not particularly limited. For example, a circular shape can be selected as the sectional shape of the conductor 2, and in a case of the circular shape, its diameter is D.

The coating material discharging tank 20 houses the insulation coating material P containing resin, and has a structure in which the running wire 2' runs to the upper side from the lower side. The coating material discharging tank 20 functions to make the insulation coating material P adhered (coating) to the outer periphery of the running wire 2' when the running wire 2' passes therethrough. The coating material discharging tank 20 is heated at a specific temperature, and the housed insulation coating material P is adjusted to have a specific viscosity.

The coating die 30 has an opening part (not shown) having a size of allowing the running wire 2' to be inserted thereinto. When the running wire 2' coated with the insulation coating material P, is inserted into the opening part, the coating die 30 functions to remove extra insulation coating material P and adjust a coating amount on the outer periphery of the running wire 2', so that the outer periphery is coated with the insulation coating material P in a specific coating thickness. The size of the opening part of the coating die 30 is set, so that the coating amount (coating thickness) of the insulation coating material P is a specific value. Note that the coating die 30 is supported by a coating die holder (not shown).

The incinerator 40 functions to bake the insulation coating material P used for coating the outer periphery of the running wire 2', by heating. An insulated layer 3 thus made of the insulation coating material P by heating, is formed on the running wire 2" that passes through the incinerator 40. In the incinerator 40, the temperature of the conductor 2 of the running wire 2" is increased, due to heating of the insulation coating material P. Then, there is a risk of increasing the temperature of the conductor 2 of the running wire 2' which is introduced to the coating material discharging tank 20, and increasing the temperature of the insulation coating material P, by heat transfer. However, as described later, the variation of the temperature of the insulation coating material P is suppressed by the cooling mechanism 50.

The cooling mechanism 50 is configured to cool the running wire 2" and decrease the temperature of the conductor 2. Thus, the heat transfer to the running wire 2' is suppressed, and the running wire 2' is adjusted to a specific temperature. The cooling mechanism 50 is electrically connected to a control mechanism 70 described later, and a rotation number of a blower, etc., for example, is controlled by the control mechanism 70. The cooling mechanism 50 is not particularly limited, and for example, a primary cooling column, a secondary cooling column, a pulley cooling hood, and a cooling blower, etc., are given, or a plurality of them may be combined. When a plurality of them are combined, at least one cooling mechanism 50 of them is made to be electrically connected to the control mechanism 70.

The temperature detector 60 is configured to detect the temperature of the running wire 2'. The temperature detector 60 is electrically connected to the control mechanism 70 described later, so that the control mechanism 70 can see the temperature of the running wire 2' detected by the temperature detector 60. A position of the temperature detector 60 installed on a running route is not particularly limited, and for example, the temperature detector 60 may be installed on a place where the temperature of the running wire 2" is detected. However, the temperature of the running conductor 2 is not uniform in the longitudinal direction, but is different depending on a place where the conductor 2 is positioned. For example, the temperature is different between the running wire 2' introduced to the coating material discharging tank 20, and the running wire 2" after passing through the incinerator 40. Further, increase of the temperature of the insulation coating material P is most influenced by the temperature of the running wire 2' before being introduced to the coating material discharging tank 20. In consideration of these cases, the temperature detector 60 is preferably positioned on an upstream side of the coating material discharging tank 20. Thus, the temperature of the insulation coating material P can be more precisely controlled by measuring the temperature of the running wire 2' immediately before being introduced to the insulation coating material P, and the reduction of the viscosity can be further suppressed. The temperature detector 60 is not particularly limited, but a non-contact type is preferable.

The control mechanism 70 is electrically connected to the cooling mechanism 50 and the temperature detector 60. The control mechanism 70 sees the temperature of the running wire 2' detected by the temperature detector 60, and based on this temperature, controls the cooling mechanism 50 to cool the running wire 2" that passes through the incinerator 40, so that the temperature of the running wire 2' before being introduced to the coating material discharging tank 20 is a specific temperature. The specific temperature is the temperature not increasing the temperature of the insulation coating material P, or the temperature not greatly reducing the viscosity of the insulation coating material P even if the temperature of the insulation coating material P is increased. The specific temperature is different depending on the kind of the insulation coating material P, and therefore is suitably selected according to the kind of the insulation coating material P. According to the control mechanism 70, the temperature of the running wire 2' detected by the temperature detector 60 is feedback-controlled, to thereby control cooling by the cooling mechanism 50. Then, the temperature of the running wire 2' before being introduced to the coating material discharging tank 20 is controlled to a specific temperature. Namely, according to the control mechanism 70, increase of the temperature of the running wire 2' before being introduced to the coating material discharging tank 20 is suppressed, and increase of the temperature of the insulation coating material P due to the increase of the temperature of the running wire 2' is suppressed, in manufacturing the insulated wire 1. As a running speed, the following running speed is used: the running speed which allows the temperature of the running wire 2' to be an upper limit or more of the specific temperature when output to the cooling mechanism 50 from the control mechanism 70 is zero. The control mechanism 70 is configured as a computer including for example a central processing unit (CPU) and a memory device such as a flash memory and HDD, etc.

(2) Method for Manufacturing Insulated Wire

Regarding a method for manufacturing the insulated wire according to this embodiment, explanation is given for a case that the insulated wire 1 is manufactured using the above-mentioned manufacturing apparatus 100.

As described above, a manufacturing method according to this embodiment is configured to manufacture the insulated wire 1 while cooling the running wire 2" so that the temperature of the running wire 2' is the specific temperature, to suppress the reduction of the viscosity of the insulation coating material P during manufacture.

Namely, the method for manufacturing the insulated wire of this embodiment includes at least: coating the outer periphery of the running wire 2' with insulation coating material P discharged from the coating material discharging tank 20; baking the insulation coating material P used for coating the outer periphery of the running wire 2' by the incinerator 40; and cooling the running wire 2" by the cooling mechanism 50 so that the temperature of the running wire 2' before being coated with the insulation coating material P, is a specific temperature, based on the temperature of the running wire 2' detected by the temperature detector 60, wherein the coating, the baking, and the cooling are repeated. Thus, the insulated layer 3 is formed on the conductor 2.

Figure 3:
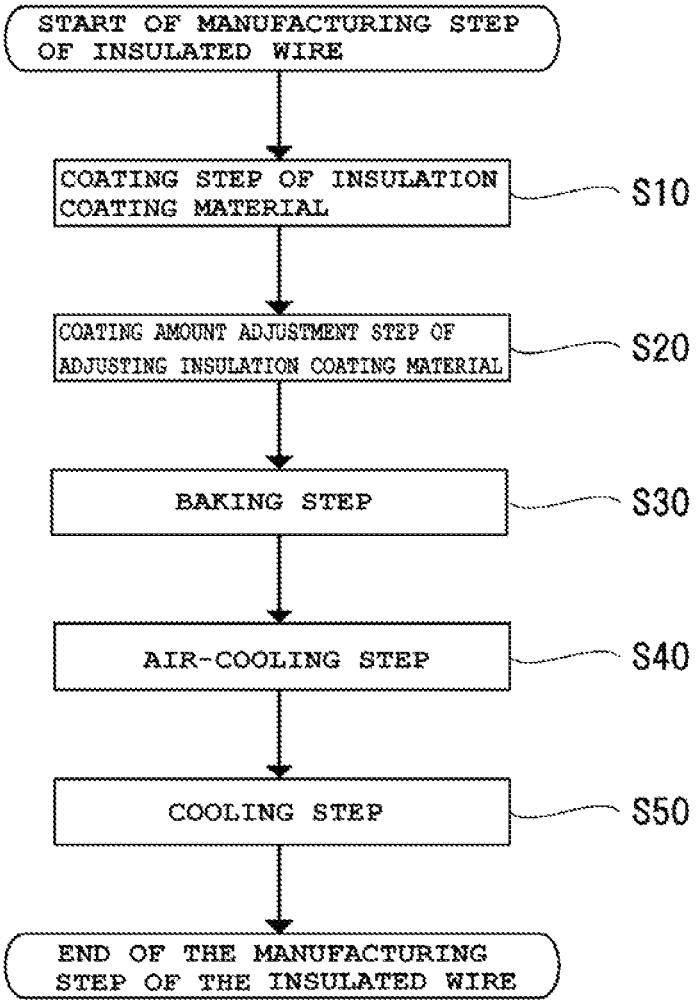
FIG. 3 is a flowchart showing a manufacturing step of the insulated wire according to an embodiment of the present invention.

Specifically, as shown in FIG. 3, the insulated wire is manufactured. FIG. 3 is a flowchart showing a manufacturing step of the insulated wire according to an embodiment of the present invention.

First, the conductor 2 is run at a specific speed by running machines 10 and 10. The conductor 2 is not particularly limited, and a conductor made of a metal material such as copper or copper alloy can be used. Further, as the sectional shape, for example, an approximately a circular shape (round type shape) or an approximately a rectangular shape (square shape), etc., can be suitably selected. Further, as a diameter of the conductor, an optimal diameter can be suitably selected according to the purpose of use, and for example, the diameter can be set to 0.1 mm or more and 5.0 mm or less. A dimension of the square conductor can be set to thickness 0.5 mm×width 0.5 mm or more thickness 5.0 mm×width 5.0 mm or less.

(Coating Step S10)

Subsequently, in the coating, the running wire 2' is introduced to the coating material discharging tank 20, to coat the outer periphery of the running wire 2' with the insulation coating material P. The insulation coating material P is not particularly limited, and a publicly-known material can be used. For example, resin containing polyimide, polyamide imide, polyester, imide, polyamide, polyester, polyurethane, polyether, polyether ketone, polyphenyl sulfide, and phenoxy resin, can be given. Further, the insulation coating material P is heated in the coating material discharging tank 20, and is adjusted to a specific viscosity. Although the viscosity of the insulation coating material P is different depending on the sectional shape of the used conductor 2, a high viscosity is preferable from a viewpoint of controlling a flowing performance of the insulation coating material P. For example, in a case of the square shaped conductor 2, the viscosity is preferably 2000 mPa·s or more and 20000 mPa·s or less. If the viscosity is less than 2000 mPa·s, control of the flowing performance of the insulation coating material P is difficult, and there is a risk of ununiform coating of the insulated layer 3. Meanwhile, if the viscosity exceeds 20000 mPa·s, due to an excessively high viscosity, a load for running the conductor 2 is great depending on the diameter of the conductor 2, and an elongation of the insulated wire 1 in the longitudinal direction becomes large, thus involving a problem that a precision is reduced in dimensions of the conductor 2 and the insulated layer 3.

(Coating Amount Adjustment Step S20)

Subsequently, in adjusting the coating amount, the running wire 2' coated with the insulation coating material P is introduced to the coating die 30, and is inserted thereinto. The coating die 30 has the opening part having a specific size. By inserting the running wire 2' into the opening part of the coating die 30, the coating amount of the insulation coating material P used for coating the outer periphery of the running wire 2' is adjusted, so that the coating amount of the insulation coating material P is a specific amount (coating thickness).

(Baking Step S30)

Subsequently, in baking, the running wire 2' coated with the insulation coating material P is introduced to the incinerator 40, and is subjected to baking by heating. The insulation coating material P becomes the insulated layer 3 having a specific thickness, in which a solvent is dried by heating. In the baking, the running wire 2' coated with the insulation coating material P has the insulated layer 3 formed thereon, to become the running wire 2". A heating temperature and a heating time for baking the insulation coating material P, are different depending on the kind of the insulation coating material P used for coating. However, the heating temperature of 250° C. or more and 600° C. or less is preferable, and the heating time of 5 seconds or more and 100 seconds or less is preferable. In the baking, there is a risk of increasing the temperature of the running wire 2", and increasing the temperature of the running wire 2' before being introduced into the coating material discharging tank 20. However, the temperature of the running wire 2" is decreased by cooling described later.

(Air-Cooling Step S40)

Subsequently, the running wire 2" that passes through the incinerator 40, is air-cooled. In the air-cooling, the insulated layer 3 is cooled.

(Cooling Step S50)

Subsequently, in cooling, the running wire 2" that passes through the incinerator 40 is introduced to the cooling mechanism 50 and is cooled. By cooling the running wire 2", the running wire 2' before being introduced to the coating material discharging tank 20 is cooled. Since the temperature of the insulation coating material P housed in the coating material discharging tank 20 is influenced by the temperature of the running wire 2', the variation of the temperature and the viscosity of the insulation coating material P is suppressed by decreasing the temperature of the running wire 2'.

In the cooling, the running wire 2" that passes through the incinerator 40 is cooled, so that the temperature of the running wire 2' is a specific temperature, based on the temperature detected by the temperature detector 60. At this time, the temperature of the running wire 2' introduced to the coating material discharging tank 20 again is also decreased to the specific temperature. The specific temperature shows the temperature allowing the viscosity of the insulation coating material P used for coating to be set in a range of 2000 mPa·s or more and 20000 mPa·s or less. In a case of the cooling, the temperature of the running wire 2' is detected by the temperature detector 60, and based on this detected temperature, the rotation number of the blower in the cooling mechanism 50 for example, is feedback-controlled, to thereby set the temperature of the running wire 2' to the specific temperature. Thus, the increase of the temperature of the running wire 2' can be suppressed, and a temperature variation and a viscosity variation of the insulation coating material P caused by the temperature variation of the running wire 2' can be suppressed. When the running wire 2' is introduced to the coating material discharging tank 20, the temperature of the running wire 2' may be increased (heated) to the specific temperature before being introduced to the coating material discharging tank 20.

Then, the thickness of the insulated layer 3 is set to a specific thickness by repeating a cycle of the above-mentioned coating step S10 to cooling step S50, with these steps as one cycle. Thus, the insulated wire 1 including the conductor 2 and the insulated layer 3 formed on the outer periphery of the conductor 2 as shown in FIG. 1, is obtained.

Effect of the Embodiment of the Present Invention

According to this embodiment, one or a plurality of effects shown below can be exhibited.

According to this embodiment, the outer periphery of the running wire is coated with the insulation coating material discharged from the coating material discharging tank, and this insulation coating material is baked by the incinerator, and thereafter the running wire is cooled by the cooling mechanism so that the temperature of the running wire immediately before being introduced to the coating material discharging tank is the specific temperature, based on the temperature of the running wire detected by the temperature detector. Thus, the temperature of the running wire is maintained to the specific temperature, and the increase of the temperature is suppressed, so that the increase of the temperature of the insulation coating material due to the increase of the temperature of the running wire can be suppressed, and the reduction of the viscosity can be suppressed. Then, the insulated wire having a uniform thickness of the insulated layer in the longitudinal direction of the insulated wire, can be obtained. Further, since the increase of the temperature of the running wire is suppressed, the running speed of the running wire can be increased, and productivity of the insulated wire can be improved. Further, since the increase of the temperature of the running wire is suppressed, the variation of the temperature of the insulation coating material due to the environment such as an air-temperature can also be suppressed.

Further according to this embodiment, the temperature of the running wire before being introduced to the coating material discharging tank is detected by the temperature detector. Thus, the temperature of the insulation coating material housed in the coating material discharging tank can be further controlled, and the reduction of the viscosity of the insulation coating material can be further suppressed.

Further according to this embodiment, when the running speed of the running wire is defined as V, and the diameter of the circle having the same sectional area as the sectional area of the conductor of the running wire is defined as D, the running wire is run so that V×D is 15 or more and 60 or less. Thus, an optimal running speed corresponding to the sectional area of the conductor can be achieved, and the productivity of the insulated wire can be improved.

Example

Next, examples of the present invention will be specifically described. However, the present invention is not limited to the examples.

(1) Material

A material used in the following examples and comparative examples is as follows.

A square conductor having a thickness of 2.0 mm, a width of 3.5 mm, and angle R of 0.3 mm, was used as the conductor. Regarding this square conductor, the diameter (D) of the circle having the same sectional area as the sectional area of this square conductor, was 2.97 mm.

As the insulation coating material, polyimide resin (Trenyce, by Toray Industries, Inc.) was used.

(2) The Manufacturing Apparatus of the Insulated Wire

In this embodiment, the above-mentioned manufacturing apparatus of the insulated wire was used, and as the cooling mechanism, the secondary cooling column, an upper pulley cover, and a lower pulley cooling hood were combined. Further, a non-contact type temperature detector is provided on the upstream side of the coating material discharging tank, to detect the temperature of the square conductor before being introduced to the coating material discharging tank.

(3) Manufacture of the Insulated Wire

The insulated wire was manufactured using the above-mentioned manufacturing apparatus.

In example 1, the square conductor is run at 10 m/min by the running machine. The running wire (running square conductor) was introduced to the coating material discharging tank, and was passed through the insulation coating material, to thereby coat the outer periphery of the running wire with the insulation coating material. Next, the coating thickness of the insulation coating material was adjusted by the coating die, and the insulation coating material was subjected to baking by the incinerator, to thereby form the insulate layer. Next, based on the temperature detected by the temperature detector, the running wire was cooled so that the temperature of the running wire was 40°, which had the insulated layer formed thereon. The insulated wire was manufactured by repeating the cycle of these steps multiple numbers of times, with these steps as one cycle, until the thickness of the insulated layer was 40 μm. Then, in this embodiment, the insulated wire was manufactured continuously for 48 hours.

Note that in example 1, the insulation coating material having the viscosity of 9000 mPa·s at 30° C. was used, and by cooling the running wire so that the temperature of the running wire was 40° C. before being coated with the insulation coating material, the viscosity of the insulation coating material during coating was adjusted to 6400 mPa·s to 6600 mPa·s, at 38° C. to 39° C. as the temperature of the insulation coating material. Further, in example 1, the air temperature was changed from 15° C. to 22° C., and the variation of the air temperature was 7° C.

In examples 2 and 3, the insulated wire was manufactured under the same condition as example 1, excluding a point that the environment for manufacturing the insulated wire was changed. In example 2, the air temperature was changed form 20° C. to 26° C. (variation was 6° C.), and the viscosity of the insulation coating material during coating was adjusted to 6100 mPa·s to 6400 mPa·s, at 39 to 40° C. as the temperature of the insulation coating material. Further, in example 3, the air temperature was changed from 30° C. to 36° C. (variation was 6° C.), and the viscosity of the insulation coating material during coating was adjusted to 5900 mPa·s to 6100 mPa·s, at 40 to 41° C. as the temperature of the insulation coating material.

In example 4, the insulated wire was manufactured under the same condition as example 2, excluding a point that the running speed of the running wire was changed to 17 m/min. The viscosity of the insulation coating material during coating was adjusted to 6100 mPa·s at 40° C. as the temperature of the insulation coating material.

In example 5, the insulating wire was manufactured under the same condition as example 2, excluding a point that the used insulation coating material was changed. Specifically, the insulation coating material having the viscosity of 13000 mPa·s at 30° C. was used, and the insulation coating material was cooled so that the temperature of the running wire was 51° C., so that the viscosity of the insulation coating material during coating was adjusted to 6200 mPa·s to 6400 mPa·s during coating, at 49° C. to 50° C. as the temperature of the insulation coating material.

In comparative examples 1 to 3, the insulated wire was manufactured similarly to the examples, excluding a point that the cooling mechanism is not provided.

Manufacturing conditions of the examples and comparative examples are shown in the following table 1.

TABLE 1

| | | Ex. 1 | | Ex. 2 | | Ex. 3 | | Ex. 4 | | Ex. 5 | | Com. Ex. 1 | | Com. Ex. 2 | | Com. Ex. 3 | |
|---|---|---|---|---|---|---|---|---|---|---|---|---|---|---|---|---|---|
| Cooling mechanism | | ON | | ON | | ON | | ON | | ON | | OFF | | OFF | | OFF | |
| Temperature (° C.) | | 15 | 22 | 20 | 26 | 30 | 36 | 20 | 26 | 20 | 26 | 15 | 22 | 20 | 26 | 20 | 26 |
| Running speed V (m/min) | | 10 | 10 | 10 | 10 | 10 | 10 | 17 | 17 | 10 | 10 | 10 | 10 | 10 | 10 | 17 | 17 |
| Manufacturing speed V × D | | 29.7 | 29.7 | 29.7 | 29.7 | 29.7 | 29.7 | 50.5 | 50.5 | 29.7 | 29.7 | 29.7 | 29.7 | 29.7 | 29.7 | 50.5 | 50.5 |
| Temperature of running wire (° C.) | | 40 | 40 | 40 | 40 | 40 | 40 | 40 | 40 | 51 | 51 | 42 | 48 | 47 | 53 | 60 | 66 |
| Temperature of insulation coating material (° C.) | | 38 | 39 | 39 | 40 | 40 | 41 | 40 | 40 | 49 | 50 | 40 | 40 | 43 | 49 | 55 | 60 |
| Viscosity of insulation coating material (mPa · s) | Temperature during coating | 6600 | 6400 | 6400 | 6100 | 6100 | 5900 | 6100 | 6100 | 6400 | 6200 | 5700 | 4600 | 5500 | 4450 | 3600 | 3050 |
| | at 30° C. | 9000 | 9000 | 9000 | 9000 | 9000 | 9000 | 9000 | 9000 | 13000 | 13000 | 9000 | 9000 | 9000 | 9000 | 9000 | 9000 |
| Insulated layer | thickest (μm) | 40 | 40 | 40 | 40 | 40 | 40 | 40 | 40 | 40 | 40 | 40 | 42 | 40 | 44 | 46 | 48 |
| | thinnest (μm) | 32 | 32 | 32 | 32 | 32 | 32 | 32 | 32 | 32 | 32 | 32 | 30 | 32 | 28 | 27 | 23 |
| | angle R (μm) | 32 | 32 | 32 | 32 | 32 | 32 | 32 | 32 | 32 | 32 | 32 | 30 | 32 | 28 | 27 | 23 |
| Variation in thickness of the insulated layer (μm) | | 8 | 8 | 8 | 8 | 8 | 8 | 8 | 8 | 8 | 8 | 8 | 12 | 8 | 16 | 19 | 25 |
| Success/Failure | | Success | | Success | | Success | | Success | | Success | | Failure | | Failure | | Failure | |

Ex. = Example

Com. Ex. = Comparative example (4) Evaluation Method

Next, the obtained insulated wire was evaluated by the following method.

(Uniformity of the Thickness of the Insulated Layer)

Regarding the thickness of the obtained insulated layer of the insulated wire, uniformity of the thickness in the longitudinal direction was evaluated. Specifically, eleven parts of the sectional surface in the longitudinal direction of the obtained insulated wire, was acquired at random. Regarding the obtained each sectional surface, the thickness at four points (A to D) shown in FIG. 1 was measured, and the variation of the thickness was calculated from a difference between a part where the thickness is largest (thickest point) and a part where the thickness is smallest (thinnest point). In this embodiment, when the variation of the thickness is 10 μm or less, this case is regarded as success, and when the variation of the thickness is larger than 10 μm, this case is regarded as failure.

In examples 1 to 5, the variation of the thickness of the insulated layer was 8 μm (thinnest point: 32 μm, and thickest point: 40 μm), and it was confirmed that the variation was suppressed to be small.

In comparative example 1, since the running wire was not cooled, it was confirmed that the temperature of the running wire was varied in a range of 42 to 48° C. In addition, since the viscosity of the insulating coating material was varied due to the variation of the temperature of the running wire, the thickness of the formed insulated layer was ununiform in the longitudinal direction, and the variation of the thickness was 12 μm (thinnest point: 30 μm and thickest point: 42 μm).

In comparative example 2, the running wire was manufactured in a high temperature environment without being cooled, and therefore the temperature of the running wire was varied in a range of 47 to 53° C. Also, the temperature of the insulation coating material was varied in a range of 43 to 49° C. corresponding to the variation of the temperature of the running wire, and the viscosity of the insulation coating material during coating was varied in a range of 4450 mPa·s to 5500 mPa·s. As a result, it was confirmed that the variation of the thickness of the formed insulated layer in the longitudinal direction of the insulated wire was 16 μm (thinnest point: 28 μm and thickest point: 44 μm).

In comparative example 3, since the running speed of the running wire was increased without being cooled, the temperature of the running wire was varied in a high range of 60 to 66° C. Then, the temperature of the insulation coating material was varied in a range of 55 to 60° C., corresponding to the variation of the temperature of the running wire, and the viscosity of the insulation coating material during coating was also varied in a range of 3050 mPa·s to 3600 mPa·s. As a result, it was confirmed that regarding the formed insulated layer, the variation of the thickness in the longitudinal direction of the insulated wire was 25 μm (thinnest point: 23 μm, and thickest point: 48 μm).

(Coating of the Insulated Layer)

Regarding the obtained insulated layer of the insulted wire, the thickness at angle R was measured, and the coating of the insulated layer by the flow of the insulation coating material was evaluated.

In examples 1 to 5, since the viscosity of the insulation coating material could be maintained to be high, it was confirmed that the flow of the insulation coating material from angle R could be suppressed, and the coating of the insulated layer could be uniform.

Meanwhile, in comparative examples 1 to 3, the viscosity of the insulation coating material could not be maintained to be high, and it was confirmed that the coating of the formed insulated layer was ununiform.

(5) Evaluation Result

As described above, according to the present invention, increase of the temperature of the insulation coating material due to the increase of the temperature of the running wire, and the reduction of the viscosity can be suppressed by cooling the running wire, so that the temperature of the running wire is a specific temperature. Further, the reduction of the viscosity of the insulation coating material due to an environment such as an air temperature, can be suppressed. Thus, ununiformity of the thickness of the insulated layer coated with the insulation coating material and formed by baking, can be suppressed in the longitudinal direction of the insulated wire, and by increasing the running speed of the running wire, the productivity of the insulated wire can be improved.

Preferable Aspects of the Present Invention

Preferable aspects of the present invention will be supplementarily described hereafter.

According to an aspect of the present invention, there is provided a method for manufacturing an insulated wire, including at least:

coating an outer periphery of a running wire with an insulation coating material discharged from a coating material discharging tank;

baking the insulation coating material by an incinerator, the insulation coating material being used for coating the outer periphery of the running wire; and cooling the running wire by a cooling mechanism so that a temperature of the running wire before being coated with the insulation coating material, is a specific temperature, based on a temperature of the running wire detected by a temperature detector, and by repeating the coating, the baking, and the cooling.

Preferably, in the cooling, the temperature of the running wire before being introduced to the coating material discharging tank is detected by the temperature detector.

Further preferably, when a running speed pf the running wire is defined as V, and a diameter of a circle having the same sectional area as a sectional area of a conductor of the running wire is defined as D, the running wire is run so that V×D is 15 or more and 60 or less.

Further preferably, viscosity of the insulation coating material is 2000 mPa·s or more and 20000 mPa·s or less.

According to other aspect of the present invention, there is provided a manufacturing apparatus of an insulated wire including:

a coating material discharging tank configured to coat an outer periphery of a running wire with an insulation coating material;

an incinerator configured to bake the insulation coating material used for coating the running wire;

a temperature detector configured to detect a temperature of the running wire;

a cooling mechanism configured to cool the running wire; and a control mechanism configured to control the cooling mechanism so that the temperature of the running wire is a specific temperature.

Further preferably, the temperature detector is provided on an upstream side of the coating material discharging tank.

What is claimed is:

1. A method for manufacturing an insulated wire, the method comprising at least:

a) coating an outer periphery of a square running wire, obtained by running a conductor which is rectangular in cross section, with a liquid insulation coating material having a predetermined viscosity range by introducing the square running wire into the liquid insulation coating material stored in a coating material supply tank;

b) baking the liquid insulation coating material coated in coating on the outer periphery of the square running wire;

c) cooling the coated wire which has been heated during baking;

d) adjusting the cooling based upon detecting a temperature of the square running wire using a temperature detector positioned on an upstream side of the coating material supply tank before it is reintroduced into the liquid insulation coating material stored in the coating material supply tank to prevent heat from the baked wire from changing viscosity of the liquid insulation coating material outside the predetermined viscosity range, wherein the predetermined viscosity range is determined within the coating material supply tank and is between 5900 mPa·s or more and 6600 mPa·s or less wherein the square running wire is run so that V×D is 15 or more and 60 or less, V being a running speed of the square running wire in meters per minute and D being a diameter in millimeters of a circle having a same sectional area as a sectional area of the conductor; and e) repeating (a)-(d).

2. The method of claim 1, wherein a time for the baking is 5 seconds or more and 100 seconds or less.

3. The method of claim 1, further comprising adjusting an amount of the liquid insulation coating material coated on the outer periphery of the square running wire by introducing the square running wire coated with the liquid insulation coating material into a coating die prior to baking.

4. The method of claim 1, wherein a temperature for the baking is 250° C. or more and 600° C. or less.

5. The method of claim 1, wherein the predetermined viscosity range enables formation of a uniform thickness of the coating at the running speed.

6. The method of claim 1, wherein a final insulated coating thickness is 50 μm or less.

7. The method of claim 1, wherein the liquid insulating coating material is selected from the group consisting of resin containing polyimide, polyamide imide, polyester, imide, polyamide, polyester, polyurethane, polyether, polyether ketone, polyphenyl sulfide, and phenoxy resin.

8. The method of claim 1, wherein the conductor is run at a speed of at least 10 m/min.

9. The method of claim 1, wherein cooling the square running wire coated with the liquid insulation coating material includes using a cooling mechanism including a blower.

* * * * *